US009487005B2

(12) United States Patent
Domae et al.

(10) Patent No.: US 9,487,005 B2
(45) **Date of Patent: *Nov. 8, 2016**

(54) LIQUID JET HEAD AND LIQUID JET APPARATUS

(71) Applicant: SII PRINTEK INC., Chiba-shi, Chiba (JP)

(72) Inventors: Yoshinori Domae, Chiba (JP); Yuki Yamamura, Chiba (JP)

(73) Assignee: SII PRINTEK INC. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/570,051

(22) Filed: Dec. 15, 2014

(65) Prior Publication Data

US 2015/0174902 A1 Jun. 25, 2015

(30) Foreign Application Priority Data

Dec. 24, 2013 (JP) ..... 2013-265513

(51) Int. Cl.
*B41J 2/045* (2006.01)
*B41J 2/14* (2006.01)

(52) U.S. Cl.
CPC ..... *B41J 2/14201* (2013.01); *B41J 2/14209* (2013.01); *B41J 2002/14411* (2013.01); *B41J 2002/14491* (2013.01); *B41J 2202/10* (2013.01); *B41J 2202/11* (2013.01); *B41J 2202/18* (2013.01)

(58) Field of Classification Search
None
See application file for complete search history.

(56) References Cited

U.S. PATENT DOCUMENTS

| | | | | |
|---|---|---|---|---|
| 5,625,393 | A * | 4/1997 | Asai | B41J 2/14209 347/68 |
| 5,680,163 | A | 10/1997 | Sugahara | 347/71 |
| 2012/0121797 | A1 * | 5/2012 | Koseki | B41J 2/14209 427/77 |

FOREIGN PATENT DOCUMENTS

| | | |
|---|---|---|
| EP | 0653303 | 5/1995 |
| EP | 0857572 | 8/1998 |
| GB | 2518506 | 3/2015 |
| JP | 7178903 | 7/1995 |

OTHER PUBLICATIONS

European Search Report mailed May 15, 2015 issued in International Appln. No. 14200093.4.

* cited by examiner

*Primary Examiner* — Erica Lin
(74) *Attorney, Agent, or Firm* — Adams & Wilks

(57) ABSTRACT

A liquid jet head includes a piezoelectric body substrate having an array of alternating ejection grooves and non-ejection grooves opening to a surface of the piezoelectric body substrate. Common drive electrodes are provided on opposed side surfaces of the ejection grooves, and individual drive electrodes are provided on opposed side surfaces of the non-ejection grooves. Two individual wirings are electrically separated from each other on the surface of the piezoelectric body substrate at opposite end sides of each non-ejection groove in a longitudinal direction, and the individual wiring at one end side is electrically connected to the individual drive electrode on one side surface of the non-ejection groove, and the individual wiring at the other end side is electrically connected to the individual drive electrode on the other side surface of the non-ejection groove.

13 Claims, 9 Drawing Sheets

LIQUID JET HEAD AND LIQUID JET APPARATUS

BACKGROUND

1. Technical Field

The present invention relates to a liquid jet head and a liquid jet apparatus that jet liquid droplets on a recording medium and perform recording.

2. Related Art

In recent years, ink jet-system liquid jet heads that eject ink droplets on a recording paper or the like to record characters and figures, or eject a liquid material on a surface of an element substrate to form a functional thin film are used. This system introduces a liquid, such as an ink, or the liquid material from a liquid tank to a channel through a supply tube, and applies a pressure to the liquid, which is filled in the channel, to eject the liquid through a nozzle that communicates with the channel, as liquid droplets. When ejecting the liquid droplets, the system moves a liquid jet head or a recording medium, and records the characters and figures or forms a functional thin film having a predetermined shape.

JP 7-178903 A describes an edge shoot-type liquid jet head 100 in which a large number of grooves is formed as channels for ejecting a liquid on a piezoelectric body substrate, and which ejects liquid droplets from end portions of the grooves. FIGS. 9A and 9B are cross-section schematic views of a liquid jet head described in JP 7-178903 A. FIG. 9A is a cross-section schematic view of the liquid jet head 100 in a direction perpendicular to a longitudinal direction of the grooves and FIG. 9B is a cross-section schematic view of an ink chamber 103 in a groove direction. The liquid jet head 100 includes a piezoelectric ceramic plate 102, a cover plate 110 bonded on an upper surface of the piezoelectric ceramic plate 102, and a nozzle plate 114 bonded on a side surface of the piezoelectric ceramic plate 102. On the piezoelectric ceramic plate 102, grooves 119 that configure the ink chambers 103 and grooves 104 in which no liquid is filled are alternately arranged sandwiching partitions 106. The cover plate 110 adheres to the upper surface of the piezoelectric ceramic plate 102 through an epoxy-based resin 120. A manifold 121 is formed on the cover plate 110, and is configured to communicate with end portions of the grooves 119 to enable liquid (ink) supply. The piezoelectric ceramic plate 102 uses a PZT ceramic plate, and is polarized into a polarization direction 105.

The grooves 104 are cut and formed to penetrate the cover plate 110 to the piezoelectric ceramic plate 102. A metal electrode 108 is formed on a side surface of the partition 106 that partitions the groove 119 and the groove 104, the side surface being at a side of the ink chamber 103, and an electrode 117 is formed on a side surface of the groove 104 of the partition 106. The metal electrode 108 is formed at an upper portion than the half of the depth of the groove 119, and is pulled out to a shallow groove 107 on a side of one end surface 115 at an opposite side to the nozzle plate 114 of the piezoelectric ceramic plate 102, as a metal electrode 109. The electrode 117 is formed on an inner-side surface and a bottom surface of the groove 104 and a flat portion 116 of the cover plate 110. The electrode 117 is set to a common electric potential, and a drive signal is provided to the metal electrode 109, so that a pressure wave is caused in the liquid filled in the ink chamber 103, and the liquid droplets are ejected through a nozzle 112.

In the liquid jet head 100 described in JP 7-178903 A, the metal electrode 109 is installed on the upper surface at the side of the one end surface 115, which is at the opposite side to the nozzle plate 114 of the piezoelectric ceramic plate 102. Each metal electrode 109 is electrically connected to each metal electrode 108 formed on the side surface of the ink chamber 103. That is, the same number of the metal electrodes 109 are formed as the number of the ink chambers 103. Therefore, if an arraying pitch of the ink chambers 103 becomes narrow, an arraying pitch of the metal electrodes 109 becomes narrow, and patterning of the metal electrodes 109 becomes micronized. Therefore, electrical connection between the micronized metal electrode 109, and wiring for supplying the drive signal from an outside, for example, wiring of a flexible circuit board, becomes difficult. Further, the groove 104 is cut and formed from the cover plate 110 side using a diamond blade. The length of the groove 104 in the groove direction is made shorter than the length of the groove 119 in the groove direction so that the diamond blade does not reach the manifold 121 when the groove 104 is formed. Therefore, the length of the piezoelectric ceramic plate 102 in the groove direction becomes long in order to secure an effective length of a drive wall.

SUMMARY OF THE INVENTION

A liquid jet head of the present invention includes: a piezoelectric body substrate including a groove array in which an ejection groove opening to a surface and a non-ejection groove opening to the surface are alternately arrayed in a reference direction, common drive electrodes installed at both side surfaces of the ejection groove, and individual drive electrodes installed at both side surfaces of the non-ejection groove, wherein the piezoelectric body substrate includes pieces of individual wiring electrically separated to each other on the surface at both end sides of the non-ejection groove in a longitudinal direction, the individual wiring at one end side is electrically connected to the individual drive electrode installed at one side surface of the non-ejection groove, and the individual wiring at the other end side is electrically connected to the individual drive electrode installed at the other side surface of the non-ejection groove.

Further, the ejection groove opens to an upper surface of the piezoelectric body substrate, and a cover plate including a liquid chamber communicating with the ejection groove, and installed on the upper surface of the piezoelectric body substrate, and a nozzle plate including a nozzle communicating with the ejection groove, and installed at a side surface of the piezoelectric body substrate, are further included.

Further, the ejection groove penetrates from an upper surface of the piezoelectric body substrate to a lower surface at an opposite side to the upper surface, the non-ejection groove opens to the upper surface of the piezoelectric body substrate, and the individual wiring is installed on the upper surface of the piezoelectric body substrate, and a cover plate including a liquid chamber communicating with the ejection groove, and installed on the upper surface of the piezoelectric body substrate, and a nozzle plate including a nozzle communicating with the ejection groove, and installed on the lower surface of the piezoelectric body substrate, are further included.

Further, the cover plate includes a first through electrode electrically connected to the individual wiring, and an individual terminal installed on a surface at an opposite side to a side of the piezoelectric body substrate, and electrically connected to the first through electrode.

Further, the individual terminal is installed on the cover plate stretching over the ejection groove in plan view as viewed from a normal direction of the upper surface of the piezoelectric body substrate.

Further, common wiring electrically connected to the common drive electrode is included on the upper surface of the piezoelectric body substrate.

Further, the cover plate includes a second through electrode electrically connected to the common wiring, and a common terminal installed on the surface at an opposite side to a side of the piezoelectric body substrate, and electrically connected to the second through electrode.

Further, the common drive electrodes installed at both side surfaces of one ejection groove and other common drive electrodes installed at both side surfaces of another ejection groove are electrically connected through the common wiring.

Further, the two individual drive electrodes installed at side surfaces of the adjacent non-ejection grooves interposing the ejection groove, the side surfaces being at sides of the ejection groove, are electrically connected through the individual terminal.

Further, a flexible circuit board including wiring is further included, and in the flexible circuit board, the wiring is electrically connected to the individual terminal, and is connected to a surface of the cover plate.

Further, the ejection groove penetrates from an upper surface of the piezoelectric body substrate to a lower surface at an opposite side to the upper surface, the non-ejection groove opens to the lower surface of the piezoelectric body substrate, and the individual wiring is installed on the lower surface of the piezoelectric body substrate, and a cover plate including a liquid chamber communicating with the ejection groove, and installed on the upper surface of the piezoelectric body substrate, and a nozzle plate including a nozzle communicating with the ejection groove, and installed at the lower surface of the piezoelectric body substrate, are included.

Further, a plurality of the groove arrays is arranged in parallel in the reference direction.

A liquid jet apparatus of the present invention includes the above-described liquid jet head; a moving mechanism adapted to relatively move the liquid jet head and a recording medium; a liquid supply tube adapted to supply a liquid to the liquid jet head; and a liquid tank adapted to supply the liquid to the liquid supply tube.

The liquid jet head according to the present invention includes a piezoelectric body substrate including a groove array in which an ejection groove opening to a surface and a non-ejection groove opening to the surface are alternately arrayed in a reference direction, common drive electrodes installed at both side surfaces of the ejection groove, and individual drive electrodes installed at both side surfaces of the non-ejection groove. The piezoelectric body substrate includes pieces of individual wiring electrically separated to each other on the surface at both end sides of the non-ejection groove in a longitudinal direction, and the individual wiring at one end side is electrically connected to the individual drive electrode installed at one side surface of the non-ejection groove, and the individual wiring at the other end side is electrically connected to the individual drive electrode installed at the other side surface of the non-ejection groove. Accordingly, an arraying pitch of the individual wiring in the reference direction becomes coarse, and electrical connection with other electrodes becomes easy.

DETAILED DESCRIPTION

First Embodiment

Figure 1:
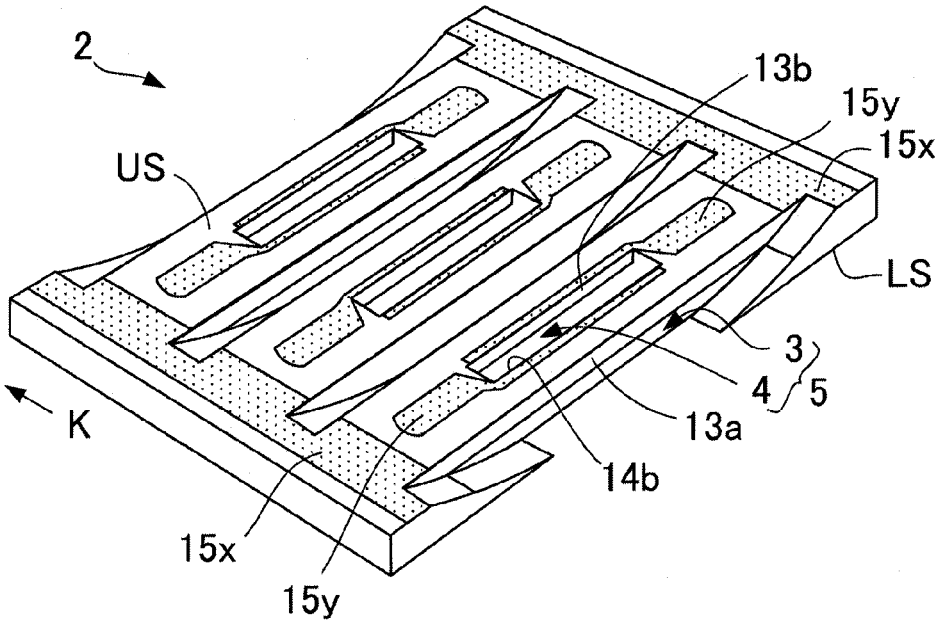
FIG. 1 is a schematic perspective view of a piezoelectric body substrate used in a liquid jet head according to a first embodiment of the present invention.

FIG. 1 is a schematic perspective view of a piezoelectric body substrate 2 used in a liquid jet head 1 according to a first embodiment of the present invention. Note that an upper surface US and a lower surface LS of the piezoelectric body substrate 2 are included in a surface of the piezoelectric body substrate 2.

The piezoelectric body substrate 2 includes a groove array 5 in which ejection grooves 3 opening to the upper surface US and non-ejection grooves 4 opening to the upper surface US are alternately arranged in a reference direction K, common drive electrodes 13*a* installed at both side surfaces of the ejection groove 3, and individual drive electrodes 13*b* installed at both side surfaces of the non-ejection groove 4. The piezoelectric body substrate 2 includes pieces of individual wiring 15*y* that are electrically separated from each other on the upper surface US at both end sides of the non-ejection groove 4 in a longitudinal direction (in the present embodiment, in a longitudinal direction of an opening portion 14*b* to which the non-ejection groove 4 opens). The individual wiring 15*y* at one end side is electrically connected to the individual drive electrode 13*b* installed at one side surface of the non-ejection groove 4, and the individual wiring 15*y* at the other end side is electrically connected to the individual drive electrode 13*b* installed at the other side surface of the non-ejection groove 4. The piezoelectric body substrate 2 further includes common wiring 15*x* electrically connected to the common drive electrodes 13*a* of the ejection grooves 3, in the upper surface US. Here, the ejection groove 3 and the non-ejection groove 4 penetrate from the upper surface US of the piezoelectric body substrate 2 into the lower surface LS of the piezoelectric body substrate 2 at an opposite side to the upper surface US. As described above, the two pieces of the individual wiring 15*y* are divided and installed to the one end side and the other end side of the non-ejection groove 4, and thus an arraying pitch of the individual wiring 15*y* in the reference direction K becomes coarse, and electrical connection between the individual wiring 15*y* and a first through electrode 20 (described in FIG. 2) becomes easy. Note that, in FIG. 1, spots are applied to the common wiring 15*x* and the individual wiring 15*y* for easy understanding.

As the piezoelectric body substrate 2, a PZT ceramic substrate can be used. Polarization processing is evenly applied to the piezoelectric body substrate 2 in a vertical direction of a substrate surface. In the present embodiment, the common drive electrodes 13*a* and the individual drive electrodes 13*b* are installed at a side closer to the upper surface US than approximately ½ of the thickness of the piezoelectric body substrate 2. Alternatively, when a chevron-type laminated piezoelectric body substrate, in which a piezoelectric body to which the polarization processing is applied upward in the vertical direction of the substrate surface and a piezoelectric body to which the polarization processing is applied downward in the vertical direction of the substrate surface are laminated, is used as the piezoelectric body substrate 2, the common drive electrodes 13*a* and the individual drive electrodes 13*b* can be installed deeper than a polarization interface from an upper end of the groove.

The piezoelectric body substrate 2 further includes the common wiring 15*x* electrically connected to the common drive electrodes 13*a* of the ejection grooves 3, in the upper surface US. The common wiring 15*x* is installed to surround the groove arrays 5 in a vicinity of end portions of the opening portions of the upper surface US, to which the ejection grooves 3 open, and is electrically connected to the plurality of common drive electrodes 13*a* installed at the side surfaces of the plurality of ejection grooves 3. That is, the common drive electrode 13*a* installed in one ejection groove 3 and another common drive electrode 13*a* installed in another ejection groove 3 are electrically connected through the common wiring 15*x*.

Note that, in the present embodiment, the ejection grooves 3 may not open to the upper surface US and may open to the lower surface LS, and the common wiring 15*x* may not be installed in the upper surface US and may be installed in the lower surface LS. That is, a case where the ejection grooves 3 or the non-ejection grooves 4 open to the upper surface US and the ejection grooves 3 or the non-ejection grooves 4 open to the lower surface LS also falls within the scope of the present invention, in addition to the case where the ejection grooves 3 and the non-ejection grooves 4 open to the upper surface US, and a case where the ejection grooves 3 and the non-ejection grooves 4 open to the lower surface LS.

Second Embodiment

Figure 2:
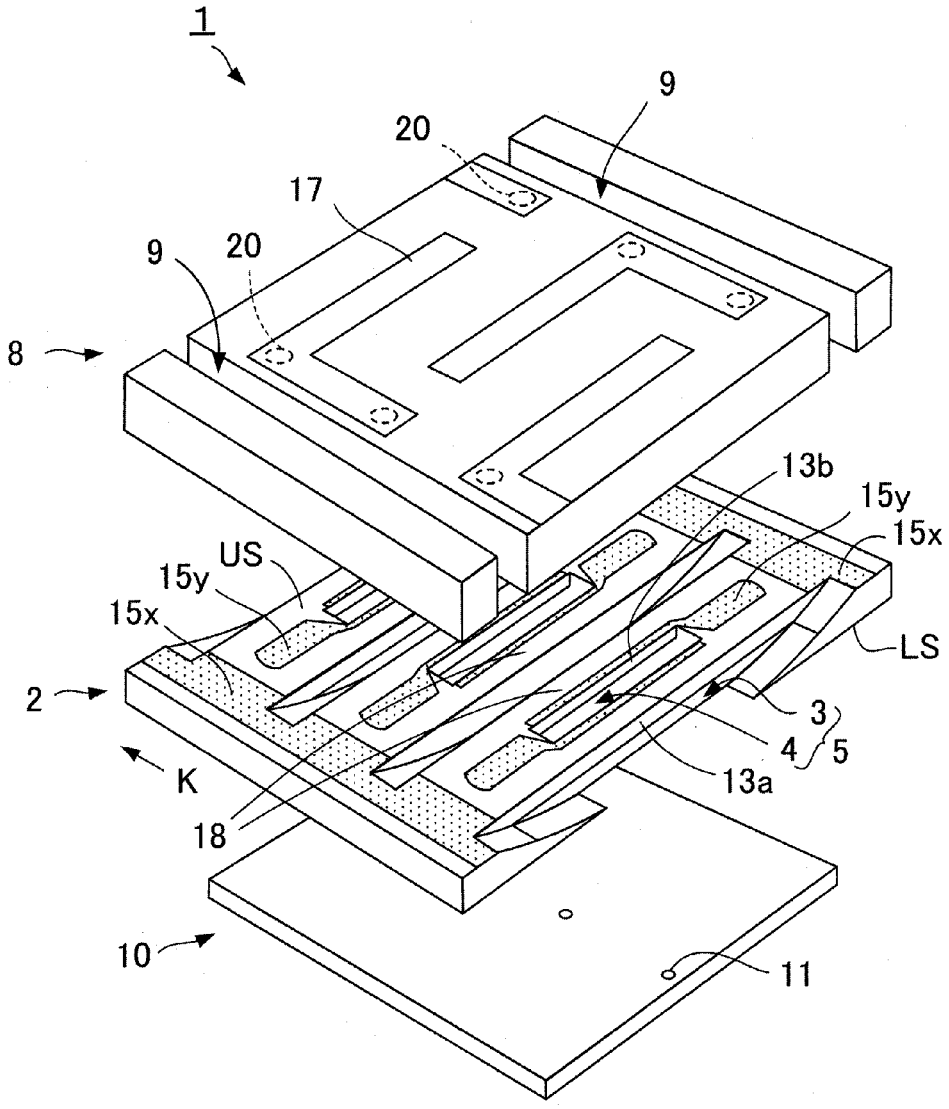
FIG. 2 is a schematic exploded perspective view of a liquid jet head according to a second embodiment of the present invention.
Figure 3A:
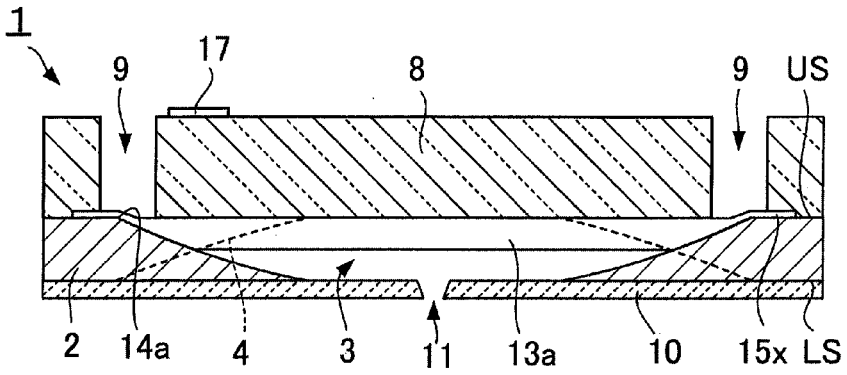
FIGS. 3A to 3C are cross-section schematic views of the liquid jet head according to the second embodiment of the present invention.
Figure 3B:
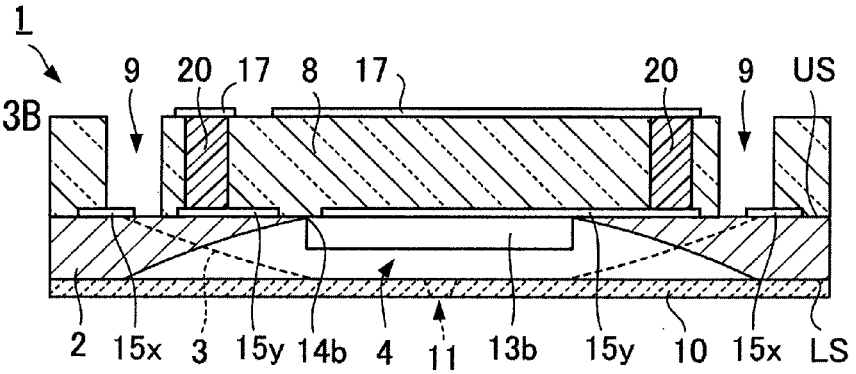
Figure 3C:
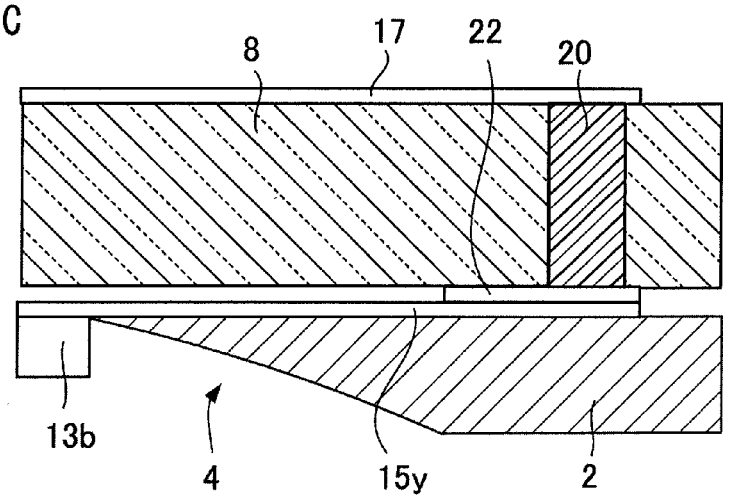

FIG. 2 is a schematic exploded perspective view of a liquid jet head 1 according to a second embodiment of the present invention. FIGS. 3A to 3C are cross-section schematic views of the liquid jet head 1 according to the second embodiment of the present invention. FIG. 3A is a cross-section schematic view of the liquid jet head 1 along an ejection groove 3, FIG. 3B is a cross-section schematic view of the liquid jet head 1 along a non-ejection groove 4, and FIG. 3C is a cross-section schematic view illustrating a modification example of a connection structure between an individual drive electrode 13*b* and a first through electrode 20. Note that the liquid jet head 1 according to the second embodiment uses a piezoelectric body substrate 2 described in the first embodiment, and thus detailed description about the piezoelectric body substrate 2 is omitted. The same portion or a portion having the same function is denoted with the same reference sign.

As illustrated in FIG. 2, the liquid jet head 1 includes the piezoelectric body substrate 2, a cover plate 8 installed on an upper surface US of the piezoelectric body substrate 2, and a nozzle plate 10 installed on a lower surface LS of the piezoelectric body substrate 2. The nozzle plate 10 includes a nozzle 11 communicating with the ejection groove 3.

The cover plate 8 includes liquid chambers 9 that communicate with the ejection grooves 3, the first through electrodes 20 electrically connected to individual wiring 15*y*, and an individual terminal 17 installed on a surface at an opposite side to the piezoelectric body substrate 2, and electrically connected to the first through electrodes 20. The individual terminal 17 has an L shape, and is, at a bottom portion of the L shape, electrically connected to two individual drive electrodes 13*b* installed at side surfaces of the adjacent non-ejection grooves 4 interposing the ejection groove 3, the side surfaces being at sides of the ejection groove 3. Therefore, the bottom portion of the L shape of the individual terminal 17 is installed on the cover plate 8 stretching or extending over the ejection groove 3 in plan view as viewed from a normal direction of the upper surface US of the piezoelectric body substrate 2.

The individual terminals 17 are installed at both end sides of the non-ejection groove 4, and the individual terminal 17 at one end side of the non-ejection groove 4 and the individual terminal 17 at the other end side are arrayed in a reference direction K such that the bottom portions of the L shapes face outward, and upper portions of the L shapes face inward. The upper portion of the L shape functions as an electrode terminal electrically connected to an external circuit. For example, a flexible circuit board is connected in the reference direction K, and wiring of the flexible circuit board and the individual terminal 17 are electrically connected, whereby a drive signal generated in the external circuit can be supplied to the individual terminal 17. Further, the individual terminal 17 can be connected with the external circuit by a wire bonding method, in place of the flexible circuit board. Accordingly, similarly to the individual wiring 15*y*, an arraying pitch of the individual terminals 17 formed on the surface of the cover plate 8 becomes coarse, and thus connection between the individual terminals 17 and other pieces of wiring such as the flexible circuit board (not illustrated) or the like becomes easy.

Specific description will be given with reference to FIGS. 3A and 3B. The ejection groove 3 has a protruding shape from the upper surface US toward the lower surface LS of the piezoelectric body substrate 2, and penetrates from the upper surface US to the lower surface LS. The non-ejection groove 4 has a protruding shape from the lower surface LS toward the upper surface US, and penetrates from the lower surface LS to the upper surface US. Therefore, the length of an opening portion 14*a* of the ejection groove 3 in a groove direction, the opening portion 14*a* opening to the upper surface US, is longer than the length of an opening portion 14*b* of the non-ejection groove 4 in the groove direction, the opening portion 14*b* opening to the upper surface US. The ejection groove 3 includes common drive electrodes 13*a* at both side surfaces, which are closer to the upper surface US than approximately ½ of the thickness of the piezoelectric body substrate 2, and the non-ejection groove 4 includes individual drive electrodes 13*b* at both side surfaces, which are closer to the upper surface US than approximately ½ of the thickness of the piezoelectric body substrate 2.

The cover plate 8 includes the two liquid chambers 9, the first through electrodes 20, and the individual terminals 17 electrically connected to the first through electrodes 20. The cover plate 8 further includes a second through electrode (not illustrated) and a common terminal (not illustrated) electrically connected to the second through electrode. One of the liquid chambers 9 communicates with end portions of one side of the plurality of ejection grooves 3, and the other liquid chamber 9 communicates with end portions of the other side of the plurality of ejection grooves 3. The non-ejection grooves 4 do not open to the upper surface US in regions where the liquid chambers 9 are installed, and thus do not communicate with the liquid chambers 9. The second through electrode penetrates in a plate thickness direction of the cover plate 8, and is electrically connected to the common wiring 15*x*. The second through electrode is installed at an end portion of the cover plate 8 in the reference direction K, and is electrically connected to the common terminal (not illustrated) installed on a surface at an opposite side to the piezoelectric body substrate 2. The first and second through electrodes, the individual terminals, and the common terminal can be formed to have low resistance by a plating method or the like. Further, as the cover plate 8, a material having a thermal expansion coefficient similar to the piezoelectric body substrate 2 can be used. For example, a PZT ceramic or a machinable ceramic can be used.

Note that, in the present invention, the individual terminal 17 having the L shape is not an essential condition, and may have a T shape, or another shape. Further, in the second embodiment, the two individual drive electrode 13*b* installed at the side surfaces at the ejection groove 3 side, of the two non-ejection grooves 4 that interpose the ejection groove 3, are electrically connected through the individual terminal 17. However, alternatively, the two individual drive electrodes 13*b* may not be electrically connected through the individual terminal 17, and may be electrically connected through another wiring or an external circuit. Further, when the arraying pitch of the ejection grooves 3 in the reference direction K becomes micronized, the arraying pitch of the individual terminals 17 in the reference direction K becomes micronized. In this case, the upper portions of the L shapes of the individual terminals 17 may just be eliminated, and the individual terminal 17 at one side and the individual terminal 17 at the other side may just be separated.

The liquid jet head 1 is driven as follows. First, a liquid is supplied to one liquid chamber 9. The liquid flows into the ejection grooves 3, and further flows into the other liquid chamber 9 and is discharged. Then, a GND electric potential is provided to the common terminal (not illustrated) and the drive signal is provided to the individual terminals 17. The GND electric potential is transmitted from the common terminal to the common wiring 15*x* through the second through electrode (not illustrated), and is provided to the common drive electrodes 13*a* of each of the ejection grooves 3. The drive signal is provided to the individual drive electrodes 13*b* of the non-ejection grooves 4 from the individual terminals 17 through the first through electrodes 20 and the individual wiring 15*y*. Then, a side wall 18 between the ejection groove 3 and the non-ejection groove 4 performs thickness slip deformation, and the volume of the ejection groove 3 is expanded, and is then contracted, so that a pressure wave is evoked to the ejection groove 3. The pressure wave is transmitted to the nozzle 11, and the liquid droplets are ejected through the nozzle 11. The drive signal can be independently provided to each of the individual terminals 17, and each of the ejection grooves 3 can be independently driven. The liquid is filled in the ejection grooves 3, but the liquid is not filled in the non-ejection grooves 4. The liquid is not in contact with the individual wiring 15*y*, the first through electrode 20, and the individual terminals 17. Therefore, even if a conductive liquid is used, the drive signal is not leaked through the liquid. Further, the individual terminals 17 and the common terminal, which input the drive signal, are installed in the cover plate 8, and thus the width of the piezoelectric body substrate 2 in the groove direction can be the same as the width of the cover plate 8, and the liquid jet head 1 can be configured small. Note that the liquid may be supplied from both of one liquid chamber 9 and the other liquid chamber 9 to the ejection grooves 3.

Note that, in the above-described embodiment, the technology of applying the GND potential to the common terminal, and applying the drive signal to the individual terminals 17 has been described. However, the invention of the present application is not limited to the embodiment. For example, the drive signal can be applied to the drive electrodes 13 of the ejection grooves 3, instead of the GND electric potential, and the GND electric potential can be applied to the non-ejection grooves 4.

FIG. 3C illustrates a modification example of the second embodiment. The cover plate 8 includes a first intermediate electrode 22 on a back surface at the side of the piezoelectric body substrate 2. The first intermediate electrode 22 is electrically connected to the first through electrode 20, and is electrically connected to the individual wiring 15*y*. That is, the individual wiring 15*y* is electrically connected to the individual terminal 17 through the first intermediate electrode 22 and the first through electrode 20. Similarly, the cover plate 8 includes a second through electrode (not illustrated), a common terminal (not illustrated) installed on a surface at an opposite side to the side of the piezoelectric body substrate 2, and electrically connected to the second through electrode, and a second intermediate electrode (not illustrated) installed on a back surface of the side of the piezoelectric body substrate 2, and electrically connected to the second through electrode. The second intermediate electrode is electrically connected to the common wiring 15*x*. That is, the common wiring 15*x* is electrically connected to the common terminal through the second intermediate electrode and the second through electrode. The individual wiring 15*y* and the first intermediate electrode 22, and the common wiring 15*x* and the second intermediate electrode may directly come in contact with each other to be electrically connected, or may be electrically connected through an anisotropic conductive sheet. With the installation of the first intermediate electrode 22 and the second intermediate electrode, electrical contact resistance between the piezoelectric body substrate 2 side and the cover plate 8 side can be decreased. Further, it is not necessary to install the first through electrode 20 on the individual wiring 15*y*, or not necessary to install the second through electrode on the common wiring 15*x*, and thus the degree of freedom in design is enhanced.

Note that, in the second embodiment, the ejection grooves 3 and the non-ejection grooves 4 are formed using a dicing blade having a cutting material embedded in a periphery of a disk-like blade. Therefore, a groove end portion has a slope having a rising or falling end portion. However, the groove end portion being made to the slope is not an essential condition of the present invention, and the groove may be a groove that penetrates from the upper surface US to the lower surface LS in a straight manner. Even in this case, the length of the non-ejection grooves 4 in the groove direction is formed shorter than the length of the ejection grooves 3 in the groove direction so that the non-ejection grooves 4 do not communicate with the liquid chambers 9 of the cover plate 8 bonded on the upper surface US.

Further, in the second embodiment, the common wiring 15*x* and the individual wiring 15*y*, which are installed on the upper surface US of the piezoelectric body substrate 2, are pulled out to the outer surface of the cover plate 8 through the through electrodes. However, the present invention is not limited to the configuration. For example, the width of the piezoelectric body substrate 2 in the groove direction is formed wider than the width of the cover plate 8 in the groove direction, and the cover plate 8 is installed on the upper surface US so that the common wiring 15*x* and the individual wiring 15*y* are exposed. A flexible circuit board is connected to the exposed common wiring 15*x* and individual wiring 15*y*, and the drive signal generated by an external circuit can be transmitted to the individual drive electrodes 13*b*. Even in this case, the individual wiring 15*y* is divided into the one end side and the other end side of the non-ejection groove 4, and thus the arraying pitch of the individual wiring 15*y* in the reference direction K becomes coarse, and the electrical connection between wiring of the flexible circuit board and the individual wiring 15*y* becomes easy.

Third Embodiment

Figure 4A:
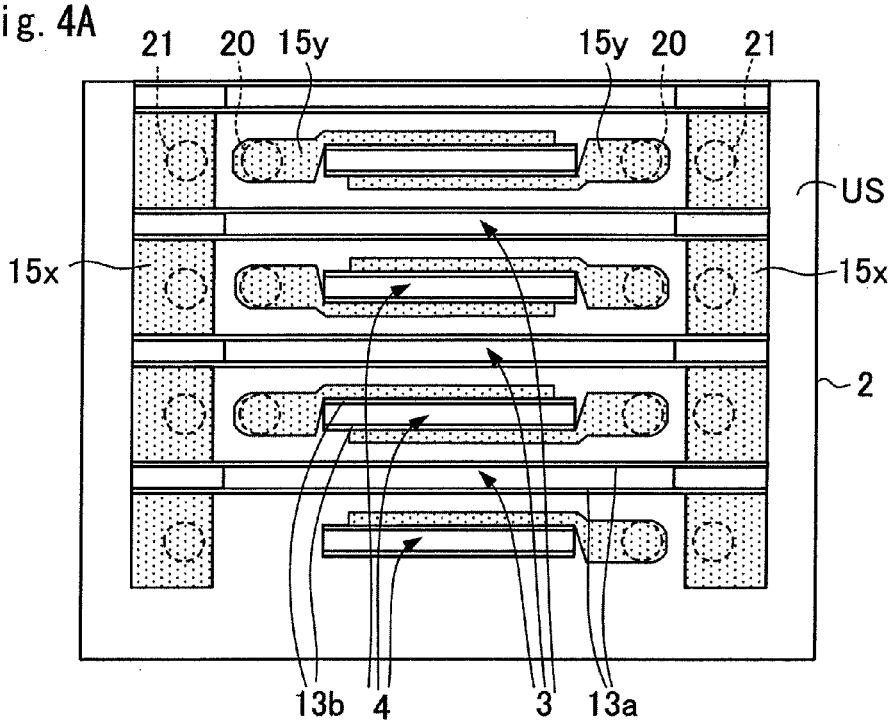
FIGS. 4A and 4B are explanatory diagrams of a liquid jet head according to a third embodiment of the present invention.
Figure 4B:
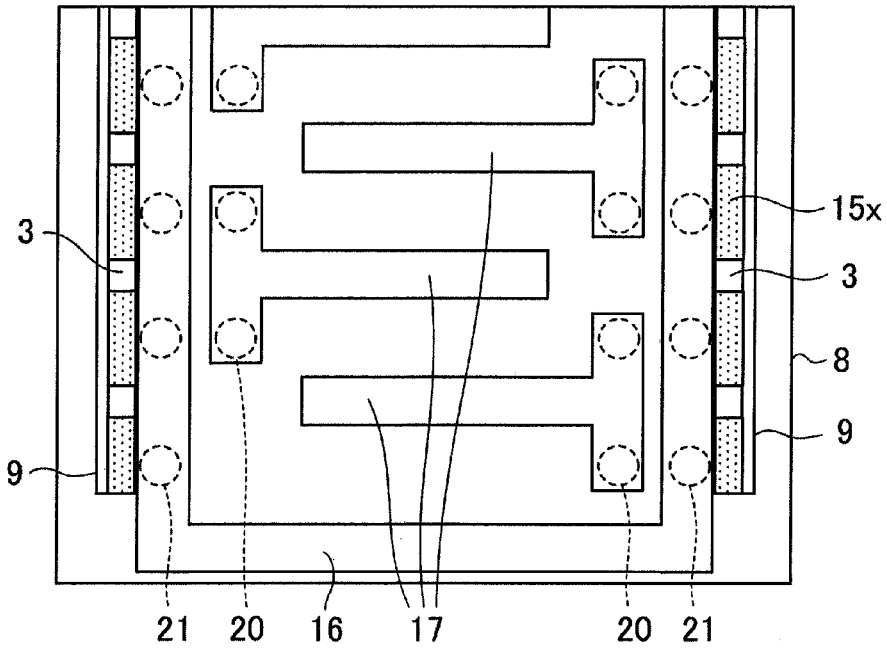

FIGS. 4A and 4B are explanatory diagrams of a liquid jet head 1 according to a third embodiment of the present invention FIG. 4A is a schematic diagram of an upper surface of a piezoelectric body substrate 2, and FIG. 4B is a schematic diagram of an upper surface of a cover plate 8. In the present embodiment, the shape of a common terminal 16 is specifically illustrated, and a plurality of second through electrodes 21 is installed corresponding to ejection grooves 3, and individual terminals 17 have a T shape. Other configurations are similar to the second embodiment. Hereinafter, different configurations to the second embodiment will be mainly described, and description of the same configurations is omitted. The same portion or a portion having the same function is denoted with the same reference sign.

As illustrated in FIG. 4A, common wiring 15*x* is installed in a vicinity of both ends of the ejection groove 3, and on an upper surface US of the piezoelectric body substrate 2 between the adjacent ejection grooves 3. The common wiring 15*x* is electrically connected to common drive electrodes 13*a* installed at side surfaces of the adjacent ejection grooves 3. The two common drive electrodes 13*a* installed at both side surfaces of the ejection groove 3 are electrically connected on a bottom portion of rising slopes of both end portions of the ejection groove 3. Therefore, all of the common drive electrodes 13*a* installed in the ejection grooves 3 are electrically connected through the common wiring 15*x*. In other words, the common drive electrodes 13*a* installed in one ejection groove 3 and other common drive electrodes 13*a* installed in the other ejection groove 3 are electrically connected through the common wiring 15*x* installed on the upper surface US of the piezoelectric body substrate 2. Further, similarly to the second embodiment, pieces of individual wiring 15*y* electrically separated to each other on the upper surface US at both end sides of non-ejection grooves 4 in a longitudinal direction, the individual wiring 15*y* at one end side is electrically connected to the individual drive electrode 13*b* installed on one side surface of the non-ejection groove 4, and the individual wiring 15*y* at the other end side is electrically connected to the individual drive electrode 13*b* installed on the other side surface of the non-ejection groove 4.

The cover plate 8 includes second through electrodes 21 installed between the adjacent ejection grooves 3, corresponding to the common wiring 15*x*. In the present embodiment, pieces of the common wiring 15*x* are installed in the vicinities of both ends of the ejection grooves 3, and the second through electrodes 21 are installed corresponding to respective pieces of the common wiring 15*x*. Therefore, the cover plate 8 includes the second through electrodes 21 twice the number of the ejection grooves 3. The cover plate 8 further includes the common terminal 16 electrically connected to each of the second through electrodes 21, on a surface at an opposite side to the side of the piezoelectric body substrate 2. Therefore, the two common drive electrodes 13*a* installed at the both side surfaces of the ejection groove 3 are electrically connected to the common terminal 16 though the two second through electrodes 21. In other words, the common drive electrode 13*a* installed in one ejection groove 3 and the other common drive electrode 13*a* installed in another ejection groove 3 are electrically connected through the common terminal 16 installed on the surface of the cover plate 8. Further, similarly to the first embodiment, the cover plate 8 includes first through electrodes 20 electrically connected to the individual wiring 15*y*, and individual terminals 17 installed on a surface at an opposite side to the side of the piezoelectric body substrate 2, and electrically connected to the first through electrodes 20.

As described above, the second through electrodes 21 are installed in the vicinities of the both ends of each of the ejection grooves 3, whereby electrical resistance between the common terminal 16 and the common drive electrodes 13*a* is decreased, and ejection abnormality of the liquid droplets due to wiring resistance is decreased. Note that the second through electrodes 21 are installed in the vicinities of the both ends of each of the ejection grooves 3. However, the second through electrode 21 may be installed at only one side of the ejection groove 3, may be installed at every two ejection grooves 3, or may be sparsely installed. In short, the second through electrodes 21 may just be installed with density not to cause the ejection abnormality to occur. Further, the individual terminal 17 has the T shape, and functions as a terminal electrically connected to an external circuit, where upper portions of the T shape are electrically connected to the two first through electrodes 20, and a lower portion of the T shape covers the ejection groove 3.

Fourth Embodiment

Figure 5A:
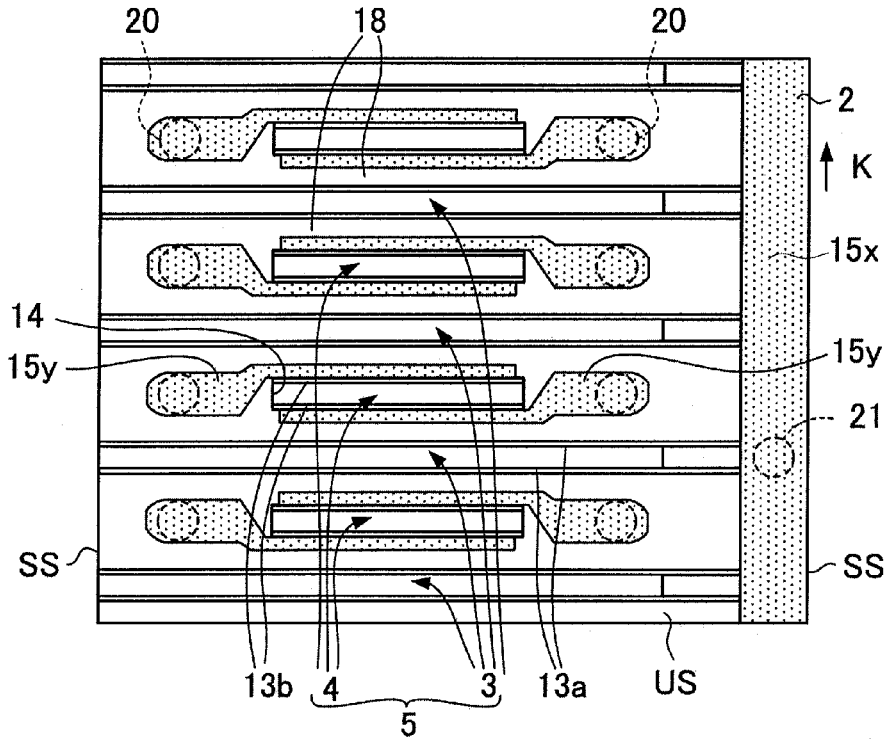
FIGS. 5A and 5B are explanatory diagrams of a liquid jet head according to a fourth embodiment of the present invention.
Figure 5B:
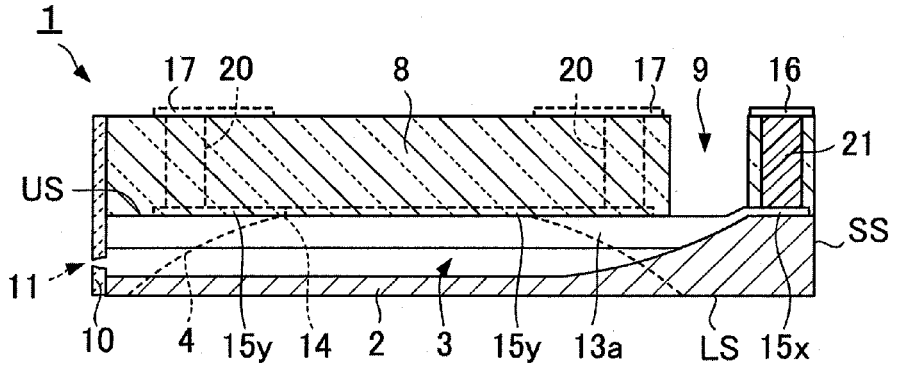

FIGS. 5A and 5B are explanatory diagrams of a liquid jet head 1 according to a fourth embodiment of the present invention. FIG. 5A is a schematic diagram of an upper surface of a piezoelectric body substrate 2 of the liquid jet head 1, and FIG. 5B is a cross-section schematic view of an ejection groove 3 of the liquid jet head 1 in a groove direction. The same portion or a portion having the same function is denoted with the same reference sign.

The liquid jet head 1 includes the piezoelectric body substrate 2, a cover plate 8 installed on an upper surface US of the piezoelectric body substrate 2, and a nozzle plate 10 installed on a side surface SS of the piezoelectric body substrate 2. The piezoelectric body substrate 2 includes a groove array 5 in which ejection grooves 3 opening to the upper surface US and non-ejection grooves 4 opening to the upper surface US are alternately arrayed in a reference direction K, common drive electrodes 13*a* installed at both side surfaces of the ejection groove 3, and individual drive electrodes 13*b* installed at both side surfaces of the non-ejection groove 4. The piezoelectric body substrate 2 includes pieces of individual wiring 15*y* electrically separated to each other on the upper surface at both end sides of the non-ejection groove 4 in the longitudinal direction (in the present embodiment, in the longitudinal direction of an opening portion 14 to which the non-ejection groove 4 open). The individual wiring 15*y* at one end side is electrically connected to the individual drive electrode 13*b* installed at one side surface of the non-ejection groove 4, and the individual wiring 15*y* at the other end side is electrically connected to the individual drive electrode 13*b* installed at the other side surface of the non-ejection groove 4. The piezoelectric body substrate 2 further includes, on the upper surface US, common wiring 15*x* electrically connected to the common drive electrodes 13*a* of the ejection grooves 3.

The cover plate 8 includes a liquid chamber 9 that communicates with the ejection grooves 3, first through electrodes 20 electrically connected to the individual wiring 15*y*, a second through electrode 21 electrically connected to the common wiring 15*x*, individual terminals 17 electrically connected to the first through electrodes 20, and a common terminal 16 electrically connected to the second through electrode 21. The individual terminals 17 and the common terminal 16 are installed on a surface of the cover plate 8 at an opposite side to the piezoelectric body substrate 2. The individual terminals 17 are installed at both end sides of the non-ejection groove 4, and each of the individual terminals 17 electrically connects two individual drive electrodes 13*b* installed at side surfaces of the adjacent non-ejection grooves 4 interposing the ejection groove 3, the side surfaces being at sides of the ejection groove 3. Therefore, each of the individual terminal 17 is installed on the cover plate 8 stretching over the ejection groove 3 in a plan view as viewed from a normal direction of the upper surface US of the piezoelectric body substrate 2. The nozzle plate 10 includes a nozzle 11 communicating with the ejection groove 3.

As described above, the individual wiring 15*y* is divided and installed to the one end side and the other end side of the non-ejection groove 4. Therefore, an arraying pitch of the individual wiring 15*y* in the reference direction K becomes coarse, and electrical connection between the individual wiring 15*y* and the first through electrodes 20 becomes easy. Similarly, an arraying pitch of the individual terminals 17 formed on the surface of the cover plate 8 becomes coarse. Therefore, connection between the individual terminals 17 and wiring of a flexible circuit board (not illustrated) becomes easy.

The piezoelectric body substrate 2 will be specifically described, The ejection grooves 3 are formed from short of one side surface SS to short of the other side surface SS, and the non-ejection grooves 4 are formed from one side surface SS to short of the other side surface SS. The ejection grooves 3 open to the upper surface US, and do not open to the lower surface LS. The non-ejection grooves 4 are ground and formed with a dicing blade from the side of the lower surface LS, and are caused to penetrate the upper surface US. An external shape of the dicing blade is transferred to both end portions of the non-ejection groove 4, and the non-ejection groove 4 has a protruding shape from the lower surface LS toward the upper surface US. The liquid chamber 9 formed in the cover plate 8 communicates with the ejection groove 3 at the other side end portion. The non-ejection grooves 4 do not open to the upper surface US of the piezoelectric body substrate 2, to which the liquid chamber 9 of the cover plate 8 opens. Therefore, it is not necessary to provide, in the liquid chamber 9, a slit for preventing the liquid chamber 9 from communicating with the non-ejection grooves 4.

Fifth Embodiment

Figure 6:
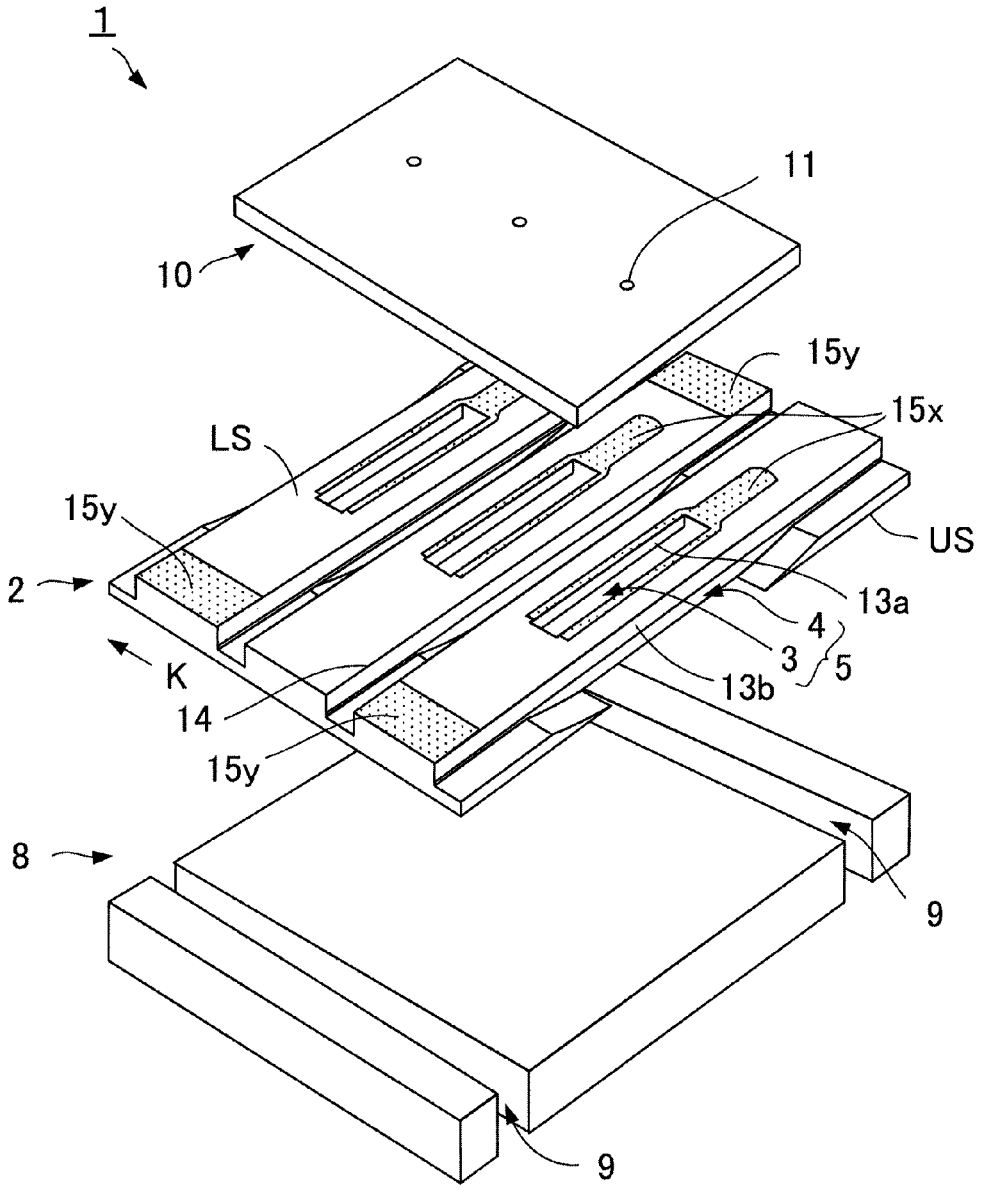
FIG. 6 is a schematic exploded perspective view of a liquid jet head according to a fifth embodiment of the present invention.
Figure 7A:
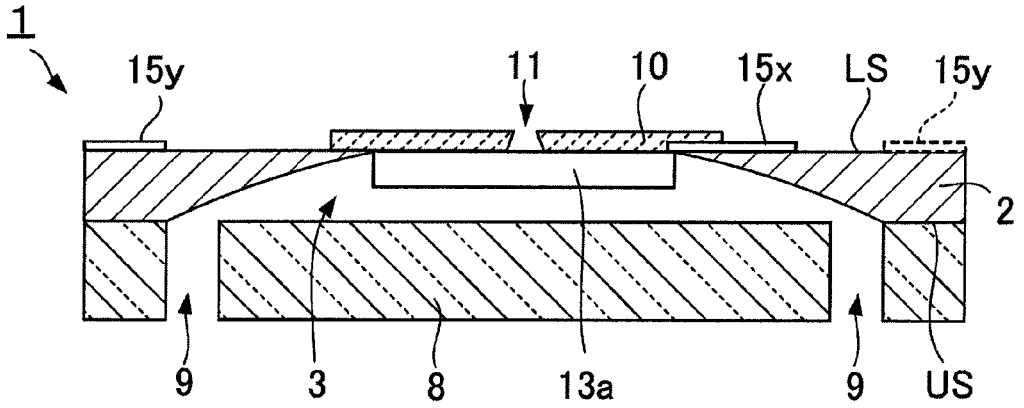
FIGS. 7A and 7B are cross-section schematic views of the liquid jet head according to the fifth embodiment of the present invention.
Figure 7B:
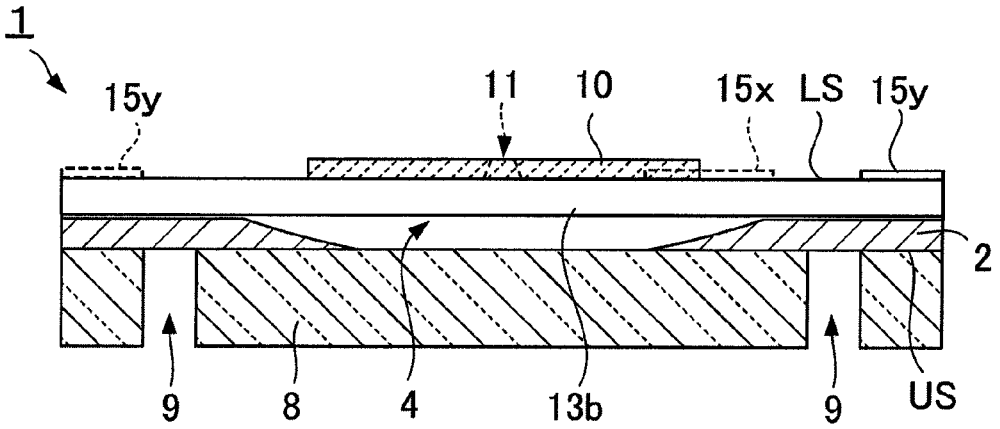

FIG. 6 is a schematic exploded perspective view of a liquid jet head 1 according to a fifth embodiment of the present invention. FIGS. 7A and 7B are cross-section schematic views of the liquid jet head 1 according to the fifth embodiment of the present invention. FIG. 7A is a cross-section schematic view of the liquid jet head 1 along an ejection groove 3, and FIG. 7B is a cross-section schematic view of the liquid jet head 1 along a non-ejection groove 4. Note that, between FIG. 8, and FIGS. 7A and 7B, drawings are inverted upside down. A point different from the first embodiment is that common wiring 15*x* and individual wiring 15*y* are installed on a lower surface LS of a piezoelectric body substrate 2, on which a nozzle plate 10 is installed. The same portion or a portion having the same function is denoted with the same reference sign.

As illustrated in FIG. 6, the liquid jet head 1 includes the piezoelectric body substrate 2, a cover plate 8 installed on an upper surface US of the piezoelectric body substrate 2, and the nozzle plate 10 installed on the lower surface LS of the piezoelectric body substrate 2. The piezoelectric body substrate 2 includes a groove array 5 in which the ejection grooves 3 opening to the lower surface LS and the non-ejection grooves 4 opening to the lower surface LS are alternately arrayed in a reference direction K, common drive electrodes 13*a* installed at both side surfaces of the ejection groove 3, and individual drive electrodes 13*b* installed at both side surfaces of the non-ejection groove 4. The piezoelectric body substrate 2 includes pieces of individual wiring 15*y* electrically separated to each other on the lower surface LS at both end sides of the non-ejection groove 4 in a longitudinal direction (in the present embodiment, in a longitudinal direction of an opening portion 14 to which the non-ejection groove 4 opens). The individual wiring 15*y* at one end side is electrically connected to the individual drive electrode 13*b* installed at one side surface of the non-ejection groove 4, and the individual wiring 15*y* at the other end side is electrically connected to the individual drive electrode 13*b* installed at the other side surface of the non-ejection groove 4. The piezoelectric body substrate 2 further includes, on the lower surface LS, common wiring 15*x* electrically connected to the common drive electrodes 13*a* of the ejection groove 3. Here, the ejection grooves 3 and the non-ejection grooves 4 penetrate from the lower surface LS of the piezoelectric body substrate 2 to the upper surface US. However, the present invention is not limited to the embodiment, and the non-ejection grooves 4 may not penetrate the side of the upper surface US.

The nozzle plate 10 includes a nozzle 11 communicating with the ejection groove 3, and is installed on the lower surface LS of the piezoelectric body substrate 2. The width of the nozzle plate 10 in a groove direction is narrower than the width of the piezoelectric body substrate 2 in the groove direction, and when the nozzle plate 10 of the piezoelectric body substrate 2 is installed, the individual wiring 15*y* formed on the lower surface LS at the both end sides of the non-ejection groove 4 and the common wiring 15*x* formed on one side are exposed. The exposed common wiring 15*x* and individual wiring 15*y*, and wiring of a flexible circuit board (not illustrated) are electrically, connected, and a drive signal can be supplied from an outside. Two liquid chambers 9 are formed on the cover plate 8, and one liquid chamber 9 communicates with one end portion of the ejection groove 3, and the other liquid chamber 9 communicates with the other end portion of the ejection groove 3. As described above, the individual wiring 15*y* is divided and installed to the one end side and the other end side of the non-ejection groove 4, and thus an arraying pitch of the individual wiring 15*y* in the reference direction K becomes coarse, and connection with other electrodes becomes easy. Further, the non-ejection groove 4 does not open to the upper surface US in regions where the liquid chambers 9 are installed, and it is not necessary to provide, in the liquid chamber 9, a slit for shielding communication between the liquid chambers 9 and the non-ejection groove 4.

Specific description will be described with reference to FIGS. 7A and 7B. The ejection groove 3 has a protruding shape from the upper surface US toward the lower surface LS. The non-ejection groove 4 has a protruding shape from the lower surface LS toward the upper surface US, and both end sides in the groove direction have a certain depth from the lower surface LS. The depth is approximately ½ deeper than the thickness of the piezoelectric body substrate 2. The ejection groove 3 includes the common drive electrodes 13*a* at both side surfaces, which are closer to the lower surface LS than approximately ½ of the thickness of the piezoelectric body substrate 2. The non-ejection groove 4 includes the individual drive electrodes 13*b* at both side surfaces, which are closer to the lower surface LS than approximately ½ of the thickness of the piezoelectric body substrate 2, and the individual drive electrodes 13*b* at the both side surfaces are mutually electrically separated. The common wiring 15*x* is installed at the other side than the opening portion of the ejection groove 3, which opens to the lower surface LS, and is electrically connected to the common drive electrodes 13*a* installed at the both side surfaces of the ejection groove 3. The individual wiring 15*y* at one end side of the non-ejection groove 4 is electrically connected to the individual drive electrode 13*b* installed at one side surface of the non-ejection groove 4, and the individual wiring 15*y* at the other end side is electrically connected to the individual drive electrode 13*b* installed at the other side surface of the non-ejection groove 4. Further, the two individual drive electrodes 13*b* installed at side surfaces of the two adjacent non-ejection grooves 4 interposing the ejection groove 3, the side surfaces being at sides of the ejection groove 3, are electrically connected through the individual wiring 15*y*. Therefore, the individual wiring 15*y* installed at one end side of the non-ejection grooves 4 is installed at every other ejection groove 3 arrayed in the reference direction K. The same applies to the individual wiring 15*y* installed at the other end side of the non-ejection grooves 4. As a result, the arraying pitch of the individual wiring 15*y* in the reference direction K becomes coarse, and even when the arraying pitch of the ejection grooves 3 becomes micronized, electrical connection with another wiring becomes easy. The material of the piezoelectric body substrate 2 and the operation of the liquid jet head 1 are similar to the first embodiment, and thus description is omitted.

Not that, in the present embodiment, wiring of a flexible circuit board is electrically connected to the common wiring 15*x* and the individual wiring 15*y*. However, alternatively, the nozzle plate 10 extends in the groove direction, and the nozzle plate 10 can have a function of the flexible circuit board. In this case, the wiring electrically connected to the individual wiring 15*y* is installed on the surface of the nozzle plate 10 at the side of the piezoelectric body substrate 2, a through electrode electrically connected to the common wiring 15*x* is installed on the nozzle plate 10, and wiring electrically connected to the through electrode is installed on a surface at an opposite side to the side of the piezoelectric body substrate 2. As a result, the number of components is decreased, and positioning between the nozzle 11 of the nozzle plate 10, and the ejection grooves 3 of the piezoelectric body substrate 2, and positioning of the wiring and the through electrode of the nozzle plate 10, and the common wiring 15*x* and the individual wiring 15*y* of the piezoelectric body substrate 2 can be performed at the same time, and the number of manufacturing processes is decreased.

As described above, in the first to fifth embodiments, the liquid jet heads 1 having one line of the groove array 5 have been described. However, the present invention is not limited to these embodiments, and can be applied to a case where two or more lines of the groove arrays 5 are arranged in parallel in the reference direction K.

Sixth Embodiment

Figure 8:
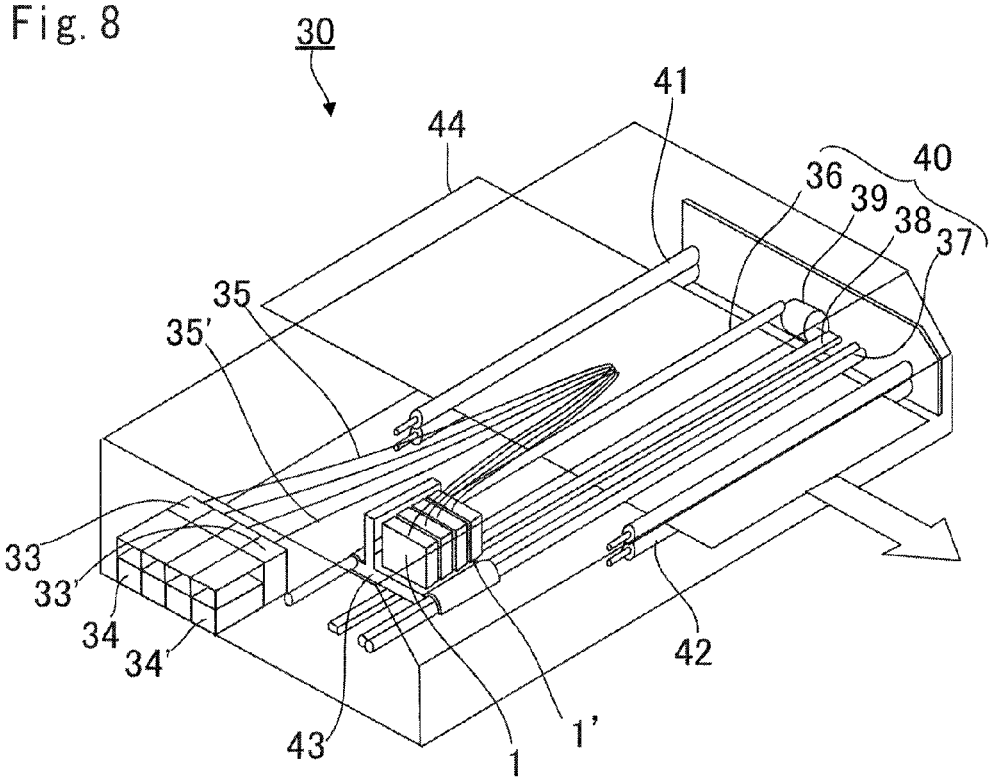
FIG. 8 is a schematic perspective view of a liquid jet apparatus according to a sixth embodiment of the present invention.
Figure 9A:
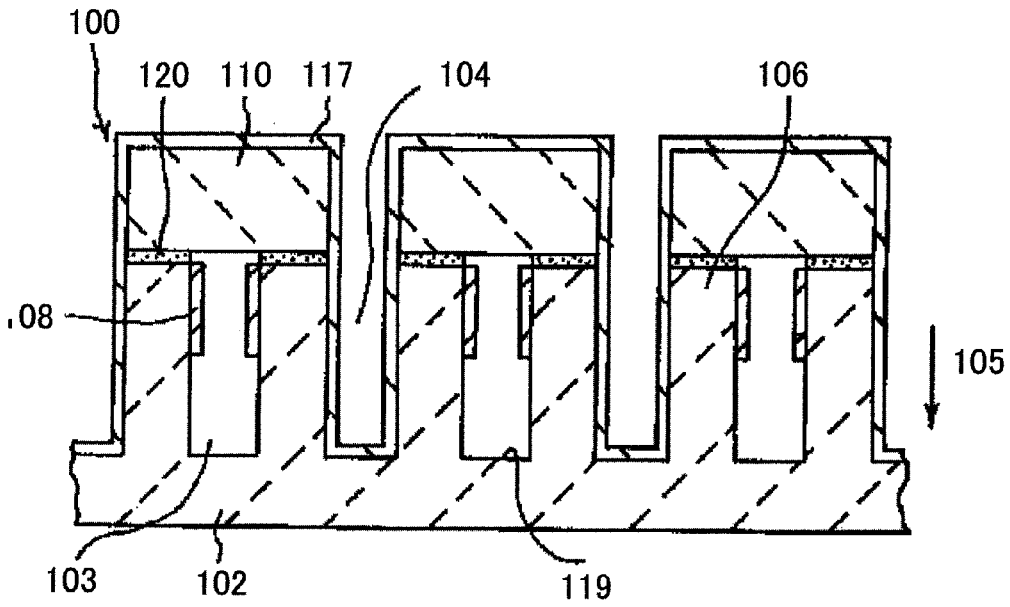
Fig. 9A Prior art
FIGS. 9A and 9B are cross-section schematic views of a conventionally known liquid jet head.
Figure 9B:
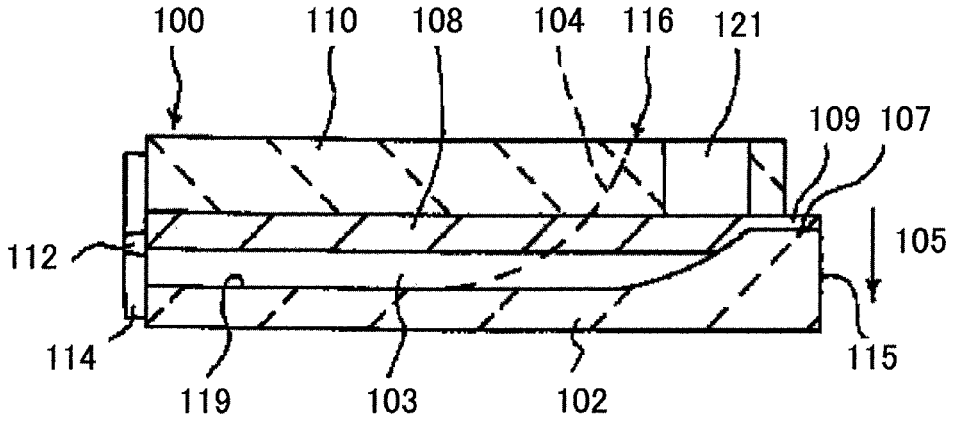
Fig. 9B Prior art

FIG. 8 is a schematic perspective view of a liquid j apparatus 30 according to a sixth embodiment of the present invention. The liquid jet apparatus 30 includes a moving mechanism 40 that reciprocates liquid jet heads 1 and 1', flow path portions 35 and 35' that supply a liquid to the liquid jet heads 1 and 1', and discharge the liquid from the liquid jet heads 1 and 1', liquid pumps 33 and 33' that communicate with the flow path portions 35 and 35', and liquid tanks 34 and 34'. As each of the liquid jet heads 1 and 1', any of the first to fifth embodiments described above is used.

The liquid jet apparatus 30 includes a pair of conveyance units 41 and 42 that conveys a recording medium 44 such as a paper in a main scanning direction, the liquid jet heads 1 and 1' that eject the liquid toward the recording medium 44, a carriage unit 43 on which the liquid jet heads 1 and 1' are placed, the liquid pumps 33 and 33' that pressurize and supply the liquid stored in the liquid tanks 34 and 34' to the flow path portions 35 and 35', and the moving mechanism 40 that scans the liquid jet heads 1 and 1' in a sub-scanning direction perpendicular to the main scanning direction. A control unit (not illustrated) controls and drives the liquid jet heads 1 and 1', the moving mechanism 40, and the conveyance units 41 and 42.

The pair of conveyance units 41 and 42 extends in the sub-scanning direction, and includes a grid roller and a pinch roller that come into contact with and rotate a roller surface. The conveyance units 41 and 42 move the grid roller and the pinch roller around axes with a motor (not illustrated) to convey the recording medium 44 sandwiched between the rollers into the main scanning direction. The moving mechanism 40 includes a pair of guide rails 36 and 37 extending in the sub-scanning direction, the carriage unit 43 slidable along the pair of guide rails 36 and 37, an endless belt 38 that couples and moves the carriage unit 43 in the sub-scanning direction, and a motor 39 that turns the endless belt 38 through a pulley (not illustrated).

The carriage unit 43 places the plurality of liquid jet heads 1 and 1', and ejects four types of liquid droplets, for example, yellow, magenta, cyan, and black. The liquid tanks 34 and 34' store the liquid of corresponding colors, and supply the liquids to the liquid jet heads 1 and 1' through the liquid pumps 33 and 33', and the flow path portions 35 and 35'. Each of the liquid jet heads 1 and 1' ejects the liquid droplet of each color according to a drive signal. The timing at which the liquids are ejected from the liquid jet heads 1 and 1', rotation of the motor 39 that drives the carriage unit 43, and a conveyance speed of the recording medium 44 are controlled, whereby an arbitrary pattern can be recorded on the recording medium 44.

Note that the present embodiment is the liquid jet apparatus 30 in which the moving mechanism 40 moves the carriage unit 43 and the recording medium 44 and performs recording. Alternatively, a liquid jet apparatus in which the carriage unit is fixed, and the moving mechanism moves the recording medium in a two-dimensional manner and performs recording may be employed. That is, the moving mechanism may just be one that relatively moves the liquid jet head and the recording medium.

What is claimed is:

1. A liquid jet head comprising:

a piezoelectric body substrate including a groove array in which ejection grooves opening to a surface of the piezoelectric body substrate and non-ejection grooves opening to the surface are alternately arrayed in a reference direction, common drive electrodes provided on opposed side surfaces of the ejection grooves, and individual drive electrodes provided on opposed side surfaces of the non-ejection grooves, wherein the piezoelectric body substrate includes two individual wirings electrically separated from each other on the surface at opposite end sides of each non-ejection groove in a longitudinal direction, the individual wiring at one end side is electrically connected to the individual drive electrode provided on one side surface of the non-ejection groove, and the individual wiring at the other end side is electrically connected to the individual drive electrode provided on the other side surface of the non-ejection groove.

2. The liquid jet head according to claim 1, wherein the ejection grooves open to an upper surface of the piezoelectric body substrate, and further comprising a cover plate including a liquid chamber communicating with the ejection grooves, and installed on the upper surface of the piezoelectric body substrate, and a nozzle plate including nozzles communicating with respective ejection grooves, and installed at a side surface of the piezoelectric body substrate.

3. The liquid jet head according to claim 1, wherein the ejection grooves penetrate from an upper surface of the piezoelectric body substrate to a lower surface at an opposite side to the upper surface, the non-ejection grooves open to the upper surface of the piezoelectric body substrate, and the individual wirings are installed on the upper surface of the piezoelectric body substrate, and further including a cover plate including a liquid chamber communicating with the ejection grooves and installed on the upper surface of the piezoelectric body substrate, and a nozzle plate including nozzles communicating with respective ejection grooves and installed on the lower surface of the piezoelectric body substrate.

4. The liquid jet head according to claim 2, wherein the cover plate includes first through electrodes electrically connected to respective individual wirings, and individual terminals installed on an upper surface of the cover plate and electrically connected to the first through electrodes.

5. The liquid jet head according to claim 4, wherein the individual terminals are installed on the cover plate and extend over the ejection grooves in plan view as viewed from a normal direction of the upper surface of the piezoelectric body substrate.

6. The liquid jet head according to claim 2, wherein common wiring electrically connected to the each common drive electrode is included on the upper surface of the piezoelectric body substrate.

7. The liquid jet head according to claim 6, wherein the cover plate includes a second through electrode electrically connected to the common wiring, and a common terminal installed on the surface at an opposite side to a side of the piezoelectric body substrate, and electrically connected to the second through electrode.

8. The liquid jet head according to claim 6, wherein the common drive electrodes on opposed side surfaces of one ejection groove and the common drive electrodes on opposed side surfaces of another ejection groove are electrically connected through the common wiring.

9. The liquid jet head according to claim 4, wherein each two individual drive electrodes on side surfaces of adjacent non-ejection grooves between which is an ejection groove, the side surfaces being at sides of the ejection groove, are electrically connected through one of the individual terminals.

10. The liquid jet head according to claim 4, further including a flexible circuit board including wiring, wherein the wiring of the flexible circuit board is electrically connected to the individual terminals, and the flexible circuit board is connected to a surface of the cover plate.

11. The liquid jet head according to claim 1, wherein the ejection grooves penetrate from an upper surface of the piezoelectric body substrate to a lower surface at an opposite side to the upper surface, the non-ejection grooves open to the lower surface of the piezoelectric body substrate, and the individual wirings are installed on the lower surface of the piezoelectric body substrate, and further including a cover plate including a liquid chamber communicating with the ejection grooves and installed on the upper surface of the piezoelectric body substrate, and a nozzle plate including a nozzles communicating with respective ejection grooves and installed on the lower surface of the piezoelectric body substrate.

12. The liquid jet head according to claim 1, wherein a plurality of the groove arrays is arranged in parallel in the reference direction.

13. A liquid jet apparatus comprising:

a liquid jet head according to claim 1;

a moving mechanism adapted to relatively move the liquid jet head and a recording medium;

a liquid supply tube adapted to supply a liquid to the liquid jet head; and a liquid tank adapted to supply the liquid to the liquid supply tube.

* * * * *